US005080614A

United States Patent [19]

Utgaren

[11] Patent Number: 5,080,614

[45] Date of Patent: Jan. 14, 1992

[54] QUICK CONNECT ELECTRICAL PLUG

[76] Inventor: Harold Utgaren, 740 Connaught Road, Victoria, British Columbia, Canada, V9A 2Z2

[21] Appl. No.: 689,958

[22] Filed: Apr. 23, 1991

[51] Int. Cl.[5] ..... H01R 13/502

[52] U.S. Cl. ..... 439/695; 439/657; 439/462; 439/936

[58] Field of Search ..... 439/335, 462, 469, 599, 439/600, 601, 686, 656, 657, 690–695, 701, 936

[56] References Cited

U.S. PATENT DOCUMENTS

| | | | |
|---|---|---|---|
| 2,815,495 | 12/1957 | Webster | 439/657 |
| 4,178,056 | 12/1979 | Lee | 439/695 X |
| 4,191,443 | 3/1980 | Doyle | 439/462 |
| 4,199,207 | 4/1980 | Lee | 439/690 X |

*Primary Examiner*—Neil Abrams
*Assistant Examiner*—Khiem Nguyen
*Attorney, Agent, or Firm*—Fleit, Jacobson, Cohn, Price, Holman & Stern

[57] ABSTRACT

There is provided a new and useful quick connect electrical connector comprising a housing having first and second ends; an open cavity extending into the first end of the housing; and a first passage extending into the second end of the housing and opening into the cavity; an insert for inserting into the cavity, the insert having first and second ends; a recess in the first end of the insert; and at least a second and a third passage leading from the second end of the insert to the recess; and a terminal section having first and second ends; electrical contacts on the second end of the terminal section corresponding to each of the at least second and third passages; and electrical conductors leading from said contacts to receptacle or plug means associated with the terminal section; cooperating means on the insert and the terminal section for aligning the terminal section and the insert for inserting the second end of the terminal section into the recess to a first insertion position wherein the contacts lie adjacent to but offset from the second and third passages; the cooperating means including limiting means for permiting a limited amount of rotation of the terminal section from the first insertion position to a second insertion position in which the contacts are moved to or just through the alignment position with the second and third passages; and means for securing the housing, the insert and the terminal section against relative movement.

24 Claims, 3 Drawing Sheets

QUICK CONNECT ELECTRICAL PLUG

FIELD OF THE INVENTION

This application relates to electrical connectors of the type which might be used, for example, to join an electrical wire or cable to a plug or receptacle to form an extension cord.

BACKGROUND OF THE INVENTION

While factory-connected wires and cables terminating in plugs or receptacles may be moulded around the actual connection of the conductors to contacts, to thereby provide a strong stable connection, such a connection is not readily obtained where a wire or cable must be joined to a plug or receptacle in the field. In most cases such connectors have in the past required the use of screw terminals in which the bare end of a wire is jammed between a screw and a contact piece.

In some cases two part housings have been provided wherein the two parts are also held together by two or more screws.

In the simplest cases these connections have tended to be lacking in strength and durability leading, for example, to the cable being pulled loose of the connection causing a short circuit or a circuit interruption. In more elaborate arrangements the connections have been more stable but have been bulky, and difficult and time consuming in assembly.

In most of these cases one had to be concerned to avoid loss of parts, such as the screws; and to have tools available, such as the proper type screwdriver.

There has clearly been an ongoing need for a connector in which the cable can be connected quickly and with minimum time input to provide a stable and durable connection without the problems noted above.

Against this background a connector has been devised which address various of these problems.

PRIOR ART

Applicant is not aware of any prior patents or other publications pertaining to the subject matter of the invention.

BRIEF SUMMARY OF THE INVENTION

A connector has now been developed which will enable plugs, receptacles and other electrical components to be connected to wires or cables quickly and in a safe and durable manner.

Thus, the invention provides a quick connect electrical connector comprising a housing, having first and second ends, an open cavity extending into the first end of the housing and a first passage extending into the second end of the housing and opening into the cavity; an insert for inserting into the cavity, the insert having first and second ends, a recess in the first end of the insert and at least a second and a third passage leading from the second end of the insert to the recess; and a terminal section having first and second ends, electrical contacts on the second end of the terminal section corresponding to each of said at least second and third passages, and electrical conductors leading from said contacts to receptacle or plug means associated with the terminal section. Cooperating means are provided on the insert and the terminal section for aligning the terminal section and the insert for inserting the second end of the terminal section into the recess to a first insertion position wherein the contacts lie adjacent to but offset from the second and third passages. The cooperating means includes limiting means for permitting a limited amount of rotation of the terminal section from the first insertion position to a second insertion position in which the contacts are moved to or just through the alignment position with the second and third passages. The connector includes means for securing the housing, the insert and the terminal section against relative movement.

BRIEF DESCRIPTION OF THE DRAWINGS

In drawings which illustrate embodiments of the invention.

Figure 1:
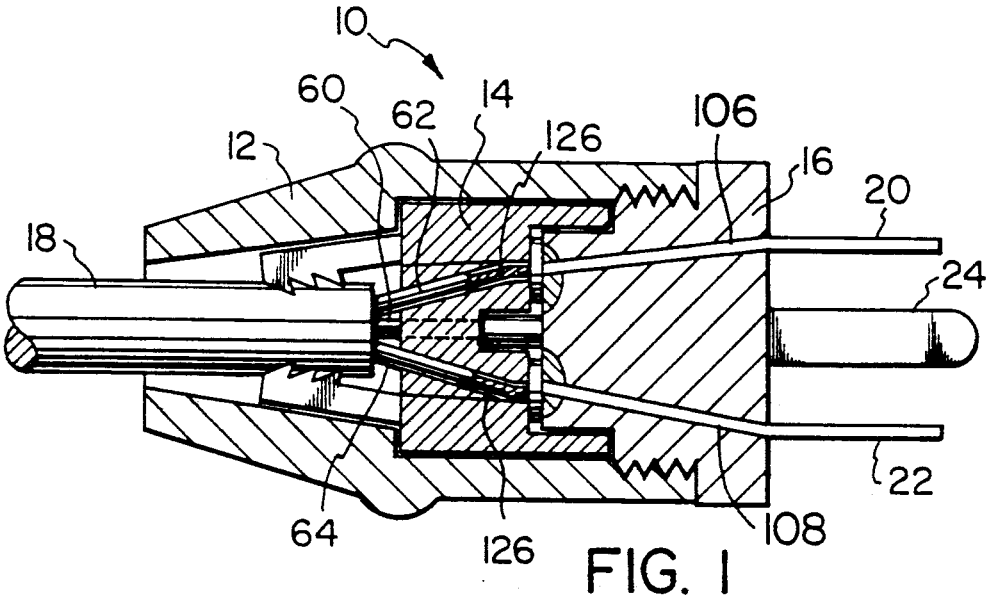
FIG. 1 is a sectional view of an assembled connector according to the invention.
Figure 2:
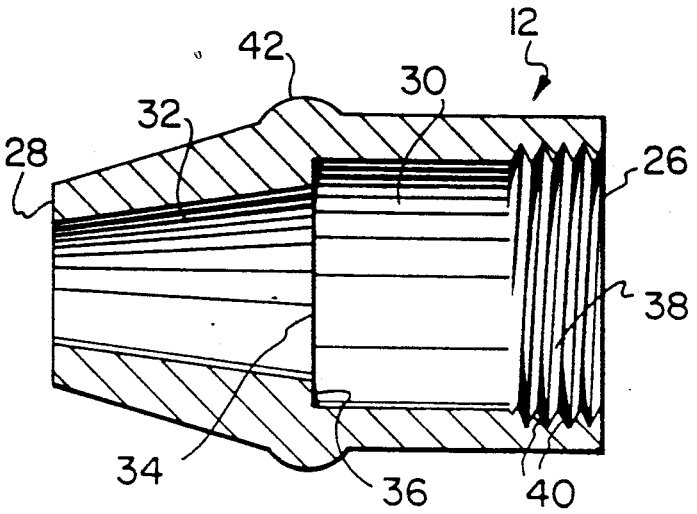
FIG. 2 is a section through a housing for use in the invention.
Figure 3:
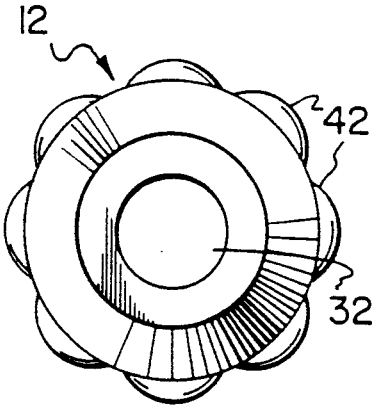
FIG. 3 illustrates one end of the housing of FIG. 2.
Figure 4:
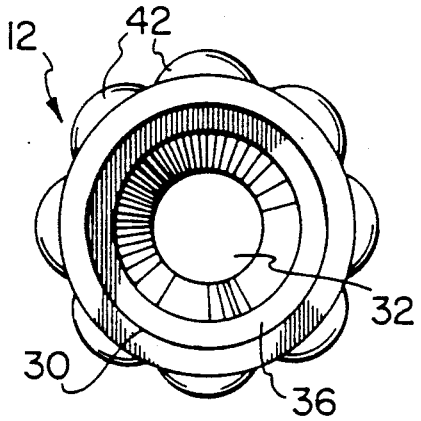
FIG. 4 illustrates the opposite end of the housing of FIG. 2.
Figure 5:
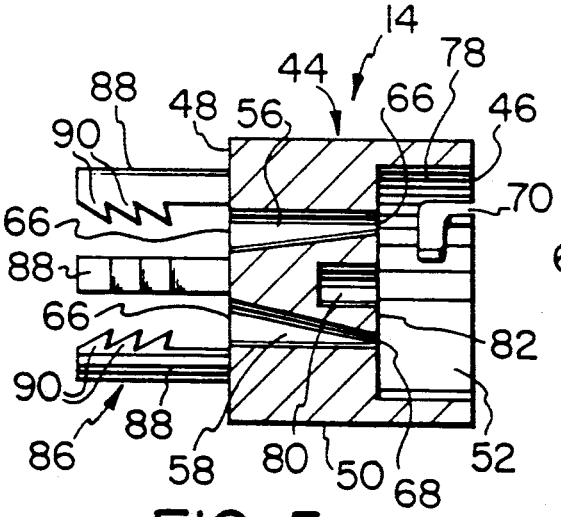
FIG. 5 is a sectional view of an insert for use in the invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

The connector 10 comprises in general a housing 12, an insert 14 and terminal section 16.

For purposes of illustration the invention is illustrated joining 3-wire cable 18 to terminal section 16 in the form of a three-pronged plug comprising live and neutral prongs 20 and 22 and ground prong 24.

The housing 12 includes first and second ends 26 and 28 respectively. Cavity 30 is recessed into end 26 of housing 12, and a passage 32 joins the second end 28 of housing 12 to the inner end 34 of cavity 30. The intersection of the passage 32 and cavity 30 preferably leaves shoulder 36 at the inner end 34 of cavity 30.

Means 38 is provided for securing the housing 12 in place in the assembled connector 10. This securing means 38 is preferably in the form of internal threads 40 in the housing 12. Cavity 30 is of cylindrical configuration at least in the area of threads 40.

In the most preferred form of the invention the housing 12 includes the knurled grip 42. As well, in the most preferred embodiment the passage 32 is at least partly tapered between the inner end 34 of cavity 30 and the end 28 of housing 12. As illustrated, the passage 32 is preferably tapered throughout its length.

The insert 14 comprises a body portion 44 having first and second ends 46 and 48 respectively. In the preferred embodiment the external surface 50 corresponds in shape to the interior shape of cavity 30 and is slightly smaller in area than cavity 30, in order to allow the insert !4 to be slid into the cavity 30.

The insert 14 includes a recess 52 in first end 46. Insert 14 also includes a series of passages 54, 56 and 58 corresponding to the conductors 60, 62 and 64 of wire 18. In the preferred case, passages 54, 56 and 58 are equally distributed around the end 48 of insert 14.

The number of such passages may for convenience generally be three, although the connector might also be used with two-conductor wires.

In the preferred case the passages 54, 56 and 58 are tapered or narrowed between the first and second ends 46 and 48 of insert 14; i.e., tapering toward first end 46. The taper is preferably such that insulated conductors 60, 62 and 64 can be inserted into the wider end 66 of the taper but only the uninsulated conductor part 126 and not the insulation will pass through the narrow end 68 of the taper.

The insert 14 also preferably includes at least two push-and-turn type slots 70 and 72 to receive corresponding push-and-turn posts 74 and 76 on terminal section 16. The slots 70 and 72 are preferably formed in the wall 78 of recess 52.

Insert 14 may also include a positioning recess 80 in the interior wall 82 of recess 52 for cooperating with a corresponding positioning post 84 on terminal section 16. The positioning means formed by positioning recess 80 and positioning post 84 aids in getting proper alignment of insert 14 with terminal section 16 and in keeping the bare wires apart.

Insert 14 also preferably includes cable clamping means 86 on the end 48 thereof. As illustrated, clamping means 86 comprises a series of gripping members 88 equally spaced about the end 48 of insert 14. Each of gripping members 88 includes at least one and preferably a series of inwardly directed teeth 90.

As is shown in FIG. 1, when insert 14 is positioned in cavity 30 of housing 12, the gripping members 88 are forced by the taper of passage 32 inwardly toward the axis of the connector to thereby engage and hold against withdrawal of a wire 18.

Figure 11:
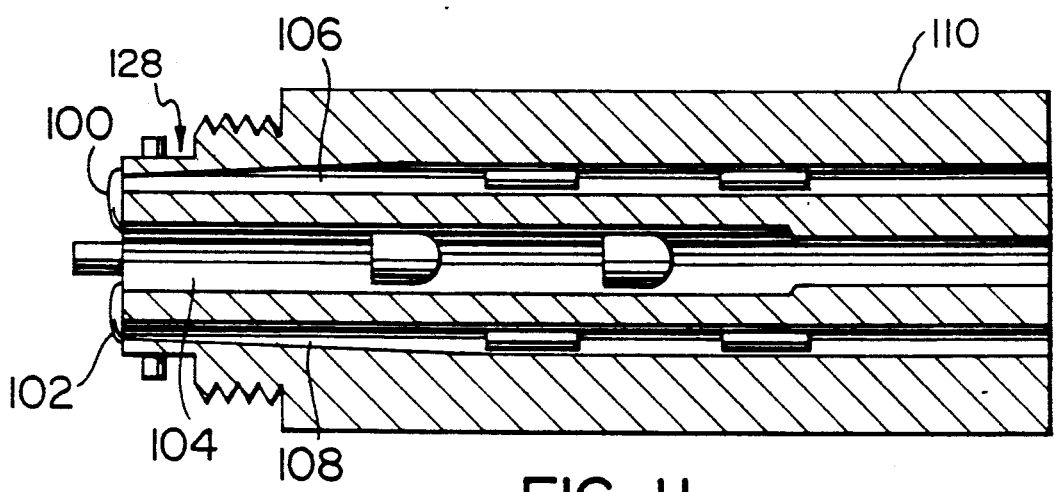
FIG. 11 illustrates a second embodiment of the terminal section for use in the invention.

The terminal section 16 comprises a body 92 having first and second ends 94 and 96. The series of electrical contacts 98, 100 and 102 are located on the end 96 spaced to correspond to the spacing of passages 54, 56 and 58 respectively of insert 14. Conductors 104, 106 and 108 extend from contacts 98, 100 and 102 respectively. In the FIG. 1 embodiment these conductors become prongs 20, 22 and 24 respectively. In the FIG. 11 embodiment the conductors 104, 106 and 108 lead to a conventional receptacle part 110. The conductors 104, 106 and 108 can clearly be utilized for other special or specific connector types.

Terminal section 16 also includes securing means 112 corresponding with the securing means 38 of housing 12. Thus, in the illustrated embodiments the securing means 112 comprises a threaded section 114.

In the preferred embodiment the terminal section 16 includes a series of depressions 116, 118 and 120 in the end 96. These depressions slope away from contacts 98, 100 and 102 respectively.

The terminal section 16 preferably also includes a shoulder 122 at one end of threaded section 114 and a further shoulder 124 at the other end of threaded section 114.

To assemble the connector in use, insulation is stripped from sections 126 of conductors 60, 62 and 64. And the conductors are then inserted into the wider end 66 of passages 54, 56 and 58. The passage are marked for live, neutral and ground conductors, and the user will ensure that the appropriate conductors are inserted into the appropriate passages. The conductors 60, 62 and 64 are pushed into the passages 54, 56 and 58 until the stripped sections 126 extend through the narrow end 68 of the passages and the conductors cannot be further inserted by reason of the insulated parts bringing up against the narrowing passages.

Figure 6:
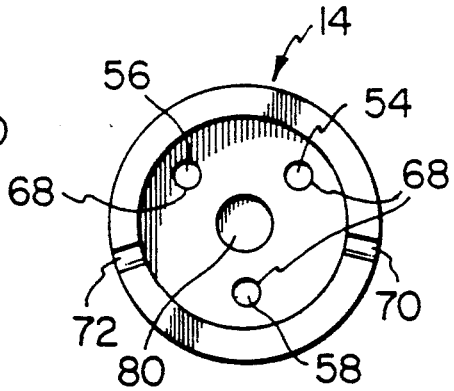
FIG. 6 illustrates one end view of the insert of FIG. 5.
Figure 7:
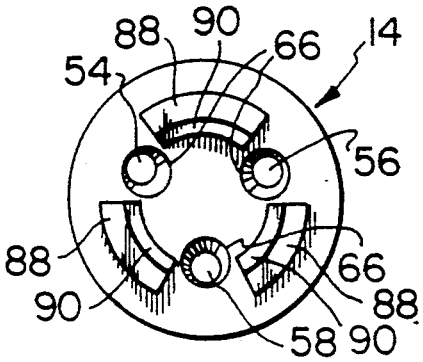
FIG. 7 illustrates the opposite end view of the insert of FIG. 5.
Figure 8:
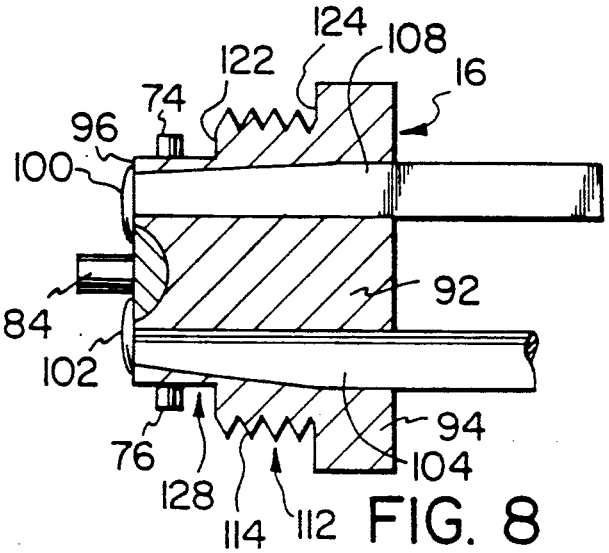
FIG. 8 is a section through a terminal section for use in the invention.
Figure 9:
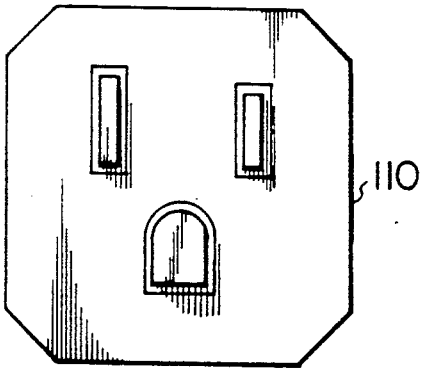
FIG. 9 is one end view of the terminal section of FIG. 8.
Figure 10:
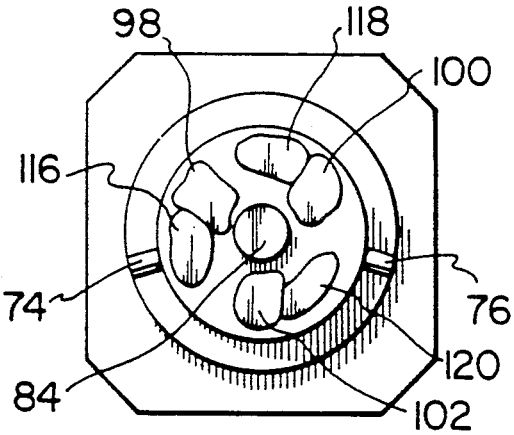
FIG. 10 is an opposite end view of the terminal section of FIG. 8.

The end part 128 of terminal 16 is then inserted into the recess 52 in the end 46 of insert 14. This is accomplished by inserting the posts 74 and 76 into the corresponding slots 70 and 72. Since the slots are asymmetrical as illustrated in FIG. 6, this insertion can be made with one orientation only. This orientation is such that contacts 98, 100 and 102 lie adjacent to the appropriate ones of the stripped sections 126 of conductors 60, 62 and 64. Similarly, the orientation is such that the stripped sections 126 actually extend into corresponding ones of the depressions 116, 118 and 120 in the end 96 of terminal section 16 and are urged by the slope of the depressions to curve away from the associated contacts 98, 100 and 102.

This insertion will be aided by the presence of the positioning post 84 and positioning recess 80 when those are utilized.

At this point the end part 128 of terminal section 16 has been inserted into the recess 52 of insert 14 but the terminal section 16 has not yet been rotated relative to insert 14. The positioning of the depressions 116, 118 and 120 relative to the associated contacts 98, 100 and 102 is chosen along with the slots 70 and 72 and the direction of the threads of threaded section 114 such that when the posts 74 and 76 are now turned in the slots 70 and 72, the contacts 98, 100 and 102 will sweep across the corresponding conductors 60, 62 and 64 to jam those conductors between the contacts and the interior wall 82 of recess 52 thus forming a good tight contact.

It should be noted although obvious that the wire 18 must be inserted through the housing 12 prior to insertion into the insert 14.

After thus rotating the terminal section 16 in recess 52, the housing 12 is then moved into position with the insert 14 extending partially into the cavity 30 and the gripping members 88 extending partly into the passage 32. At this point the threads 40 of housing 12 will engage the threaded section 114 of terminal section 16. Using the knurled grip 42, the housing 12 is then simply screwed onto the terminal section 16. In the process of so doing the gripping members 88 are forced into engagement with the wire 18.

The dimensions of the components are preferably chosen such that the end 48 of insert 14 will bring up against the shoulder 36 at the inner wall of cavity 30. At the same time the shoulder 124 of terminal section 16 will lie adjacent the end 26 of housing 12.

The action of the shoulder 36 of cavity 30 against the end 48 of insert 14 will jam the insert 14 firmly against the terminal section 16. This will add to the pressure holding the conductors on the contact by taking up any slack between posts 74 and 76 and slots 70 and 72. At the same time the interacting threads maintain the housing 12 and terminal section 16 against relative movement.

A good durable connection has thus been made.

Figure 12:
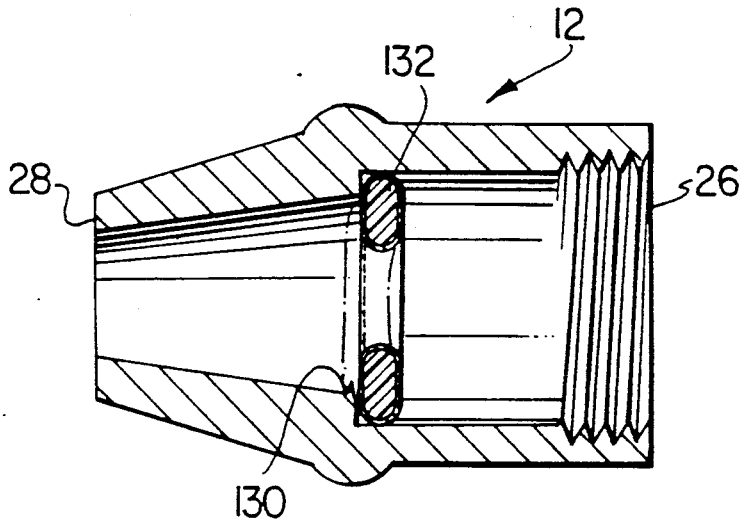
FIG. 12 is a section through a further embodiment of a housing for use in the invention.

With reference to FIG. 12, an embodiment is illustrated which includes means for waterproofing the cable inlet end of the connector 10. The housing 12 is provided with puncturing means, preferably an inwardly projecting sharp pointed protrusion 130. A rupturable container 132 is provided containing a substantially liquid waterproofing material such as a silicone composition. When the housing 12 is screwed onto terminal section 16, the container 132 is jammed and twisted against protrusion 130. Container 132 ruptures and the waterproofing material spreads across the end 48 of insert 14. The cable entry end of the connector 10 is thus effectively waterproofed.

The rupturing means 130 may optionally be located on the end 48 of insert 14.

Thus it is apparent that there has been provided in accordance with the invention an electrical connector that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A quick connect electrical connector comprising:

a housing having first and second ends; an open cavity extending into said first end of said housing; and a first passage extending into said second end of said housing and opening into said cavity;

an insert for inserting into said cavity, said insert having first and second ends; a recess in said first end of said insert; and at least a second and a third passage leading from said second end of said insert to said recess; and a terminal section having first and second ends; electrical contacts on said second end of said terminal section corresponding to each said at least second and third passages; and electrical conductors leading from said contacts to receptacle or plug means associated with said terminal section;

cooperating means on said insert and said terminal section for aligning said terminal section and said insert for inserting said second end of said terminal section into said recess to a first insertion position wherein said contacts lie adjacent to but offset from said at least second and third passages; said cooperating means including limiting means for permitting a limited amount of rotation of said terminal section from said first insertion position to a second insertion position in which said contacts are moved to or just through the alignment position with said at least second and third passages; and means for securing said housing, said insert and said terminal section against relative movement.

2. The connector of claim 1, wherein said housing includes abutment means for limiting the extent of insertion of said insert into said cavity.

3. The connector of claim 2, wherein said abutment means comprises an inner wall of said cavity defining a shoulder between said cavity and said first passage.

4. The connector of claim 1, wherein at least a part of said first passage is tapered from said cavity to said second end of said housing.

5. The connector of claim 1, wherein said insert includes cable clamping means extending outwardly from said second end of said insert.

6. The connector of claim 5, wherein said clamping means comprises at least one gripping member whereby, when said insert is inserted into said cavity, said clamping means thereby extends into said first passage and said gripping means is forced into engagement with a cable extending through said first passage.

7. The connector of claim 4, wherein said insert includes flexible, cable gripping means extending outwardly from said second end of said insert whereby when said insert is inserted into said cavity, said gripping means enters said first passage and is forced by said tapered part of said first passage into engagement with a cable extending through said first passage.

8. The connector of claim 7, wherein said gripping means comprises a series of three elongated members each having at least one gripping tooth thereon.

9. The connector of claim 1, wherein said second and third passages are tapered from said second end of said insert to said recess.

10. The connector of claim 9, wherein said insert includes a further passage, the fourth passage, similar to said second and third passages.

11. The connector of claim 10, wherein said insert and said terminal section include interacting means for aiding in positioning an end part of said terminal section in said recess.

12. The connector of claim 11, wherein said interacting means comprises a post on said second end of said terminal and a corresponding bore extending into said insert from said recess.

13. The connector of claim 1, wherein said securing means comprises a threaded section in said cavity interacting with a threaded section on said terminal section for securing said housing and said terminal section against relative movement and for jamming said insert against relative movement

14. The connector of claim 1, wherein said terminal section includes indentations in the second end thereof corresponding to each said at least second and third passages and which are in alignment with said at least second and third passages in said first insertion position.

15. The connector of claim 1, wherein said cooperating means comprises at least one post protruding radially of said terminal section and a corresponding slot in said insert and wherein said at least one slot extends longitudinally and circumferentially of said insert.

16. The connector of claim 15 including at least two said posts and slots spaced around said insert and said terminal section.

17. The connector of claim 15, wherein said limiting means comprises the ends of said slots.

18. The connector of claim 17, wherein said slots are located in a wall of said recess.

19. The connector of claim 17 wherein said slots extend first longitudinally into said recess and then turn substantially 90 degrees to extend circumferentially of said recess.

20. The connector of claim 9, wherein said passages are tapered such that a conductor and an associated insulating layer may be inserted into a wider section of said passages but only said conductor and not said insulating layer can be inserted through a narrower section of said passage, where said conductor and said insulating layer are of a size in association with which said connector is intended to be used.

21. The connector of claim 1 comprising in addition a rupturable container filled with waterproofing material for inserting between said insert and said housing such that, on inserting said insert into said cavity, said container will be ruptured.

22. The connector of claim 21 wherein at least one said insert of said housing includes rupturing means for rupturing said container when said insert is inserted into said cavity.

23. The connector of claim 22 wherein said rupturing means comprises an integral inwardly projecting sharp protrusion in said housing.

24. The connector of claim 23 wherein said projection is in said passage adjacent said cavity.

* * * * *